US010563967B2

(12) United States Patent
Muller

(10) Patent No.: US 10,563,967 B2
(45) Date of Patent: Feb. 18, 2020

(54) ELECTRONIC DETONATOR INITIATION

(71) Applicant: DETNET SOUTH AFRICA (PTY) LTD, Woodmead, Johannesburg (ZA)

(72) Inventor: Elmar Muller, Johannesburg (ZA)

(73) Assignee: DETNET SOUTH AFRICA (PTY) LTD, Johannesburg (ZA)

( * ) Notice: Subject to any disclaimer, the term of this patent is extended or adjusted under 35 U.S.C. 154(b) by 56 days.

(21) Appl. No.: 15/531,200

(22) PCT Filed: Nov. 9, 2015

(86) PCT No.: PCT/ZA2015/050022
§ 371 (c)(1),
(2) Date: May 26, 2017

(87) PCT Pub. No.: WO2016/086242
PCT Pub. Date: Jun. 2, 2016

(65) Prior Publication Data

US 2017/0328696 A1 Nov. 16, 2017

(30) Foreign Application Priority Data

Nov. 28, 2014 (ZA) ..... 2014/08747

(51) Int. Cl.
*F42D 1/05* (2006.01)

(52) U.S. Cl.
CPC ..... *F42D 1/05* (2013.01)

(58) Field of Classification Search
CPC ..... F42D 1/05
USPC ..... 102/302, 311, 312, 215, 217
See application file for complete search history.

(56) References Cited

U.S. PATENT DOCUMENTS

| | | | | |
|---|---|---|---|---|
| 4,860,653 | A | 8/1989 | Abouav | |
| 4,884,506 | A | 12/1989 | Guerreri | |
| 6,079,333 | A | 6/2000 | Manning | |
| 7,370,513 | B2 * | 5/2008 | Meyer | F42D 1/05 102/217 |
| 10,267,611 | B2 * | 4/2019 | Lownds | F42C 11/06 |
| 2002/0178955 | A1 | 12/2002 | Gavrilovic | |
| 2009/0193993 | A1 | 8/2009 | Hummel et al. | |

FOREIGN PATENT DOCUMENTS

WO WO-2012149277 A2 * 11/2012 ..... F42C 11/06

OTHER PUBLICATIONS

International Search Report and Written Opinion for Application No. PCT/ZA2015/050022 dated Jun. 29, 2016 (10 pages).
International Preliminary Report on Patentability for Application No. PCT/ZA2015/050022 dated Feb. 17, 2017 (9 pages).

* cited by examiner

*Primary Examiner* — Reginald S Tillman, Jr.
(74) *Attorney, Agent, or Firm* — Michael Best & Friedrich LLP

(57) ABSTRACT

A connector block for use with an electronic or electric detonator which includes a housing and, mounted in or to the housing, a power source, a radio receiver, a radio transmitter, a processor/logic unit and terminals for connection to at least one signal transmitting conductor.

7 Claims, 2 Drawing Sheets

ELECTRONIC DETONATOR INITIATION

BACKGROUND OF THE INVENTION

This invention relates generally to initiation of an electronic or electric detonator which may be one of a plurality of similar detonators included in a detonator system. More particularly the invention is concerned with a connector block for use with an electronic or electric detonator, and with a wireless detonator assembly.

A blast site may include a large number of boreholes each of which contains an explosive and a detonating arrangement. In a wired system the detonators in the boreholes are linked via conductors which run on the surface to one or more control points. The placement of the individual detonators into the boreholes can be a laborious and time consuming task. The interconnection of the detonators using conductive wires is also time consuming and the requirement for conductive wires adds considerably to the expense of a detonator installation. Apart therefrom, conductive wires, which are laid on the surface of the ground between boreholes, are exposed and are subject to mechanical or chemical damage before firing is to take place.

Challenges associated with establishing a blasting system and ensuring its integrity up to the time at which firing is to take place can thus be substantial.

If a blasting system is based on the use of wireless techniques then the requirement for surface conductors to interconnect detonators is eliminated. Factors which do arise though include the need to provide a separate power source at each detonator and the provision of an effective communication link which enables communication by a control device with a detonator in a borehole to take place, preferably on a two-way basis.

An object of the present invention is to address, at least to some extent, the aforementioned aspects.

SUMMARY OF THE INVENTION

The invention provides, in the first instance, a connector for use with an electronic or an electric detonator which includes a housing and, mounted in or to the housing, a power source, a radio receiver, a radio transmitter, a processor/logic unit and terminals for connection to at least one signal-transmitting conductor.

The signal-transmitting conductor may be electrically conductive or may conduct a signal which is at a light frequency or the like, ie. the conductor may be or include a fibre-optic cable. The invention is not limited in this respect. The signal-transmitting conductor may for example comprise a shock tube or a similar device.

The housing is preferably designed to be compact, waterproof and weather-resistant so that it can be positioned on surface and can tolerate exposure to the elements.

The power source may be any appropriate device e.g. a battery.

The radio receiver and the radio transmitter may respectively be adapted to receive signals from a control centre and to transmit signals to the control centre.

The connector may include a memory storage unit in which is stored an identifier which is unique to the connector, and which is accessible by the processor/logic unit.

The terminals may be positioned inside the housing at least for protection purposes or may be accessible from outside the housing.

The connector may include one or more sensors to monitor environmental and geographical parameters in a region of a borehole in which an associated detonator is located. For example, a sensor may be provided to monitor ambient temperature, a temperature inside the borehole at which the connector is used, vibration, weather-dependent factors such as wind and rain, noise and the like.

The connector may include a positional device to provide real time absolute or relative positional information. An object in this respect is that information on the position of the connector in a blast site or relative to one or more reference locations may be available for transmission to an external location e.g. a control centre.

The connector may include, via the processor/logic unit, a capability to collect information from one or more sensors, positional information from the positional device, or information from any other source deemed appropriate, eg. input from an operator, and of transmitting this information to a control centre either at regular intervals or when polled or interrogated by the control centre, or by a suitable control device.

The processor/logic unit may include the capability of encoding the information, for example by including in the collected information a unique connector identifier associated with the connector, or of encoding the collected information in such a way that it is uniquely associated with the connector.

In one form of the invention the connector includes a timer which can be reset to a starting value by means of a control signal transmitted to the connector. Timing information may be presented by the processor/logic unit at the output terminals according to requirement. The timer may form a part of the processor/logic unit.

The connector may include a capability to receive data from a tagger and to transmit data to a tagger. The tagger may be mobile and may be hand-held or it may be transported to and from the connector using an automated device. The invention is not limited in this respect. Communication between the tagger and the connector may be effected in any suitable way for example using infrared transmission techniques, radio transmission techniques, capacitive coupling or the like. The invention is not limited in this respect. Thus, in respect of the aforementioned examples, the connector may include an infrared receiver transmitter, or use may be made of the radio receiver and the radio transmitter referred to; or the connector may include a capacitive sensor/coupling unit; respectively.

The invention further extends to an assembly of an electronic or an electric detonator, and a connector of the aforementioned kind, and at least one signal-transmitting conductor connected to the detonator and to the terminals of the connector.

An electronic detonator, used in the assembly, may include an energy-storage device, a firing element and, optionally, a timer. The timer may be digitally based or use may be made of discrete components, e.g. a resistor/capacitor combination to effect timing. An electric detonator would normally not have an energy storage or timing capability and would be responsive to an instantaneous fire signal and a direct supply of energy (for its functionality).

The detonator may include a detonator identifier. The detonator identifier may be linked to the connector identifier in a unique way. Alternatively the connector identifier may be the same as the detonator identifier.

The invention further extends to a detonator system which includes a plurality of detonator assemblies, wherein each detonator assembly is of the aforementioned kind, wherein each detonator is positioned inside a respective borehole and is exposed to an explosive medium and each corresponding connector is positioned at surface adjacent a borehole which contains the detonator.

A remote control unit, which may be airborne or which may be on the ground, according to requirement, may include a transmitter which can communicate with and transmit a signal to each receiver in each respective connector. The transmitted signal may be uniquely encoded so that only a target connector is responsive to reception of the transmitted signal. Alternatively the transmitted signal may be broadcast i.e. each connector may be responsive to reception of the transmitted signal irrespective of the identifier of the connector.

In a reverse direction the respective transmitter associated with a connector may be capable of transmitting a signal to the control unit. In a variation of the invention, wherein use is made of mesh communication techniques, the connectors may be capable of interconnector communication in a bi-directional sense.

It is possible to transfer respective timing data from the control unit, e.g. a blasting machine, to each connector and for each connector then to transfer the respective timing data to a corresponding electronic detonator. It is further possible for a timing interval to be generated by each connector and for a control signal to be sent to the detonator, e.g. for firing the detonator, at the end of the timing interval. Depending on the configuration of the assembly a start signal can be transmitted, e.g. by the control unit, to commence the generation of a timing interval by a timer which is included in a respective detonator.

A particular benefit of the invention lies in the capability of each connector to monitor events at each borehole up to the time at which the associated detonator is fired. The monitored information can be transmitted, in any suitable form and at appropriate intervals, to the control unit for collection and subsequent processing. Thus it falls within the scope of the invention for all data pertaining to the implementation and firing of a detonator system to be monitored and recorded.

A further benefit is that the detonator system of the invention does not rely on the use of conductors to interconnect the detonators. Each detonator assembly is essentially a stand-alone unit but is capable of communication with a control centre or unit using normal radio frequency processes. As the connector is on or near surface, problems associated with transmitting signals through ground are avoided.

The power to operate each detonator is preferably derived from the power source included in the corresponding connector.

The intelligence required for operating a detonator, in response to a control signal, is thus preferably provided by the processor/logic unit in the connector. Similarly the energy required for the operation of a detonator is provided, preferably, from the power source in the associated connector.

Each detonator assembly thus functions in response to signals transmitted from the control unit. However if each detonator assembly has a capability to communicate with a tagger then it is also possible for the detonator assembly to receive signals or data from and to transmit signals or data to the tagger.

BRIEF DESCRIPTION OF THE DRAWINGS

The invention is further described by way of example with reference to the accompanying drawings in which.

DESCRIPTION OF PREFERRED EMBODIMENT

Figure 1:
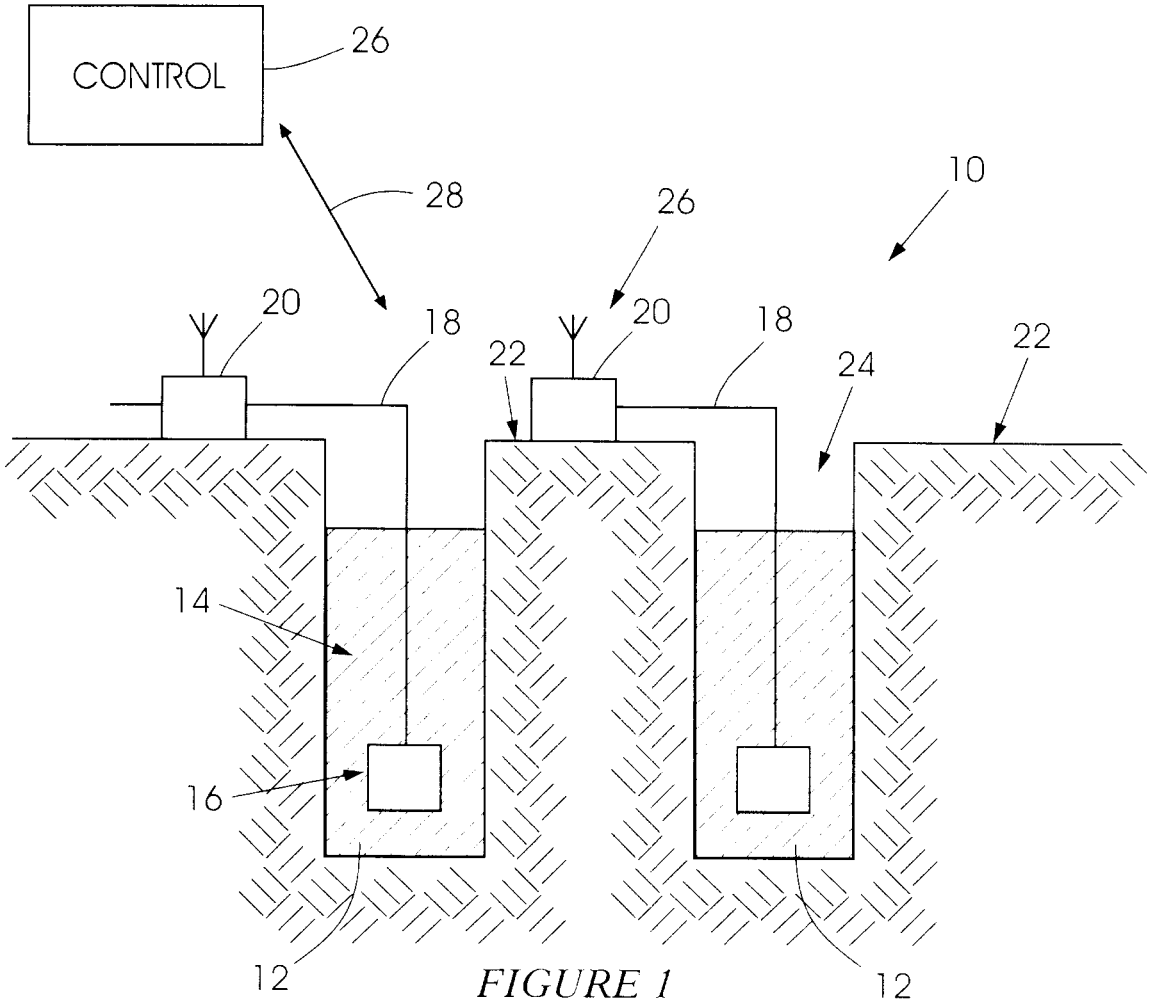
FIG. 1 illustrates a detonator system according to the invention.

FIG. 1 of the accompanying drawings illustrates part of a detonator system 10 according to the invention.

A plurality of boreholes 12 are drilled into the ground at designated locations. Each borehole contains a respective predetermined quantity of an explosive 14 e.g. an appropriate emulsion. Respectively embedded in each explosive material is at least one electronic detonator 16 which is connected, by means of a conductor 18 to a connector 20 which is positioned on a ground surface 22 at a location which is adjacent a mouth 24 of the associated borehole.

The detonator system further includes a control unit 26, e.g. a blasting machine, which has a capability to transmit and receive radio signals 28.

Figure 2:
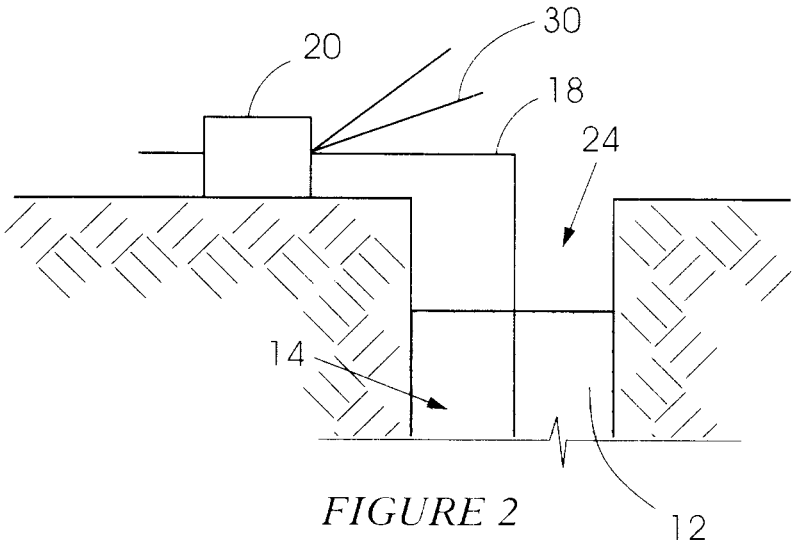
FIG. 2 shows a connector at a mouth of a borehole.

FIG. 2 illustrates the mouth 24 of a borehole 12. The corresponding connector 20 is, typically, relatively small, in a physical sense, compared to the cross-sectional area of the mouth. To prevent the connector from falling into the borehole through the mouth any appropriate mechanism may be employed. One technique is to attach to the connector a number of elongate thin projecting members 30 which extend outwardly and which are positioned and dimensioned so that it is not possible for the connector to fall through the mouth for this would be prevented by the projecting members.

Figure 3:
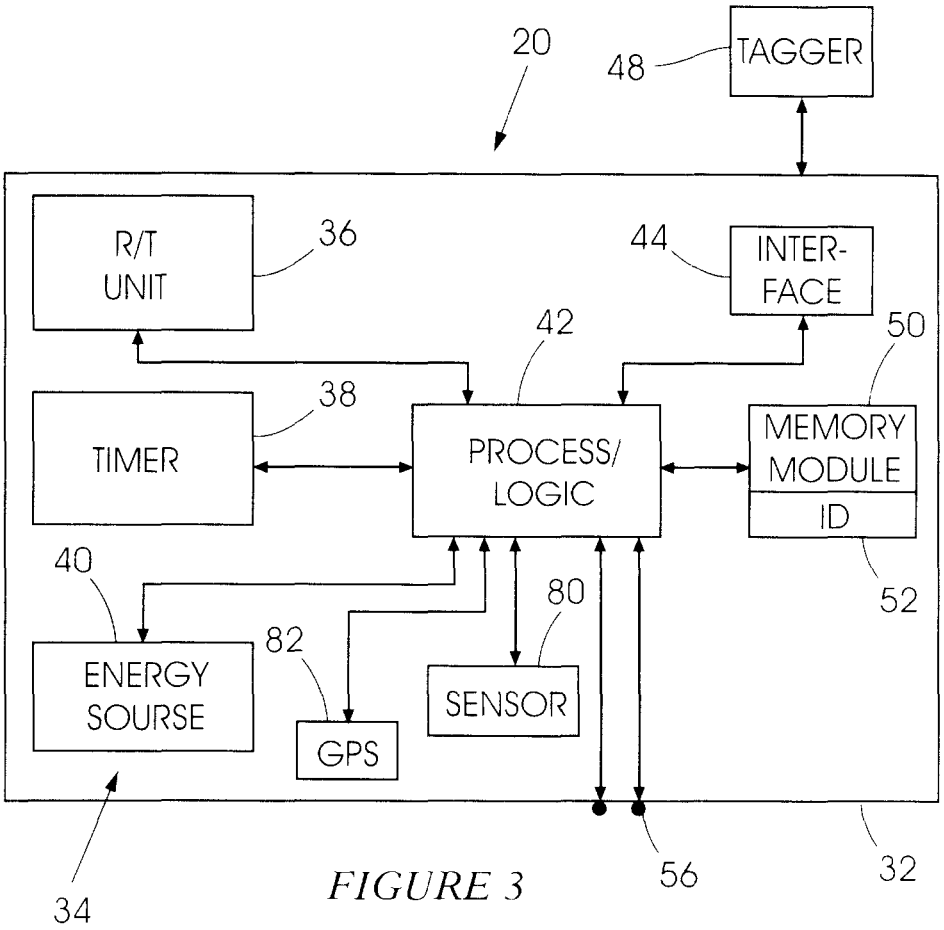
FIG. 3 is a block diagram of a circuit embodied in a connector according to the invention.

FIG. 3 is a block diagram of components in the connector 20.

The connector 20 includes a housing 32 which is made for example from a tough weather-resistant plastics material. A circuit 34 inside the housing includes a radio transmitter/receiver unit 36, an optional timer module 38, an energy source such as a suitable battery 40, and a processor/logic unit 42.

The connector may optionally include an interface module 44 which enables the connector to communicate with a tagger 46 in a bi-directional manner. The tagger typically is a mobile device which is carried by a technician, or which can be transported by an appropriate mobile carrier e.g. a radio controlled vehicle or the like. The invention is not limited in this respect.

The processor/logic unit 42 includes, or otherwise is connected to, a memory module 50 which contains an identifier 52 which is unique to the specific connector 20.

The connector has terminals 56 which are on an outer surface of the housing 32, or at a location inside the housing at which the terminals are accessible.

Figure 4:
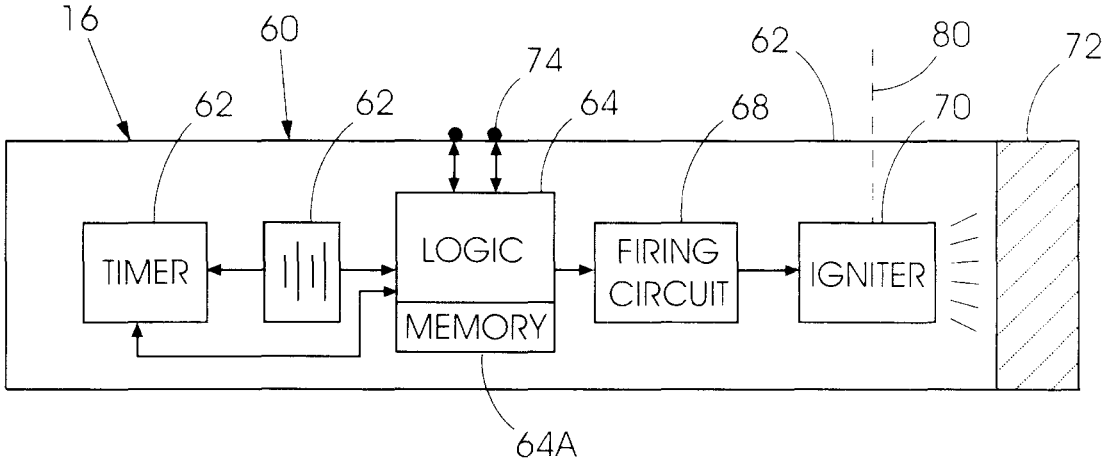
FIG. 4 is a diagrammatic representation of a detonator suitable for use in a detonator assembly according to the invention.

FIG. 4 is a representation of an electronic detonator 16 for use in the detonator system 10. The detonator 16 has an elongate tubular housing 60 in which are mounted a solid state timer 62, a logic unit 64, an energy source 66, e.g. a storage device or a battery, a firing circuit 68 and an igniter 70 which is exposed to an explosive composition 72. Terminals 74 are provided at one end of the housing 60 and are connected to the logic unit 64. The conductor 18, which may include two electrical leads, is used to connect the terminals 74 to the connector.

In use the detonator 16 is connected optionally under factory conditions or off-site conditions to an associated connector 20 by means of a respective conductor 18, to make up a detonator assembly 76.

In each detonator assembly 76 the bulk of the intelligence required for the operation of the detonator 16 is provided by the processor/logic unit 42 in the connector 20. Timing control of the detonator 16 is exercised by a delay circuit, or by the timer 62, such control can be digitally based, in which event the timer is preferably incorporated into the logic unit 64, or can be based on the use of discrete components e.g. a resistor/capacitor combination.

Each detonator assembly 76 is uniquely identified. This can be done in different ways. For example the identifier 52 in the connector 20 can be included (repeated) in a memory portion 64A of the logic unit 64 in the detonator. Alternatively the detonator can include a separate and distinct identifier, stored in the memory portion 64A, which is uniquely linked to the identifier 52 in the connector 20 either under factory conditions, or at the time of installation of the detonator 16 in a borehole.

It thus falls within the scope of the invention for a detonator and a connector to be packaged together as a detonator assembly 76 under factory conditions with one unique identifier, or with two unique identifiers which are uniquely linked to each other.

The energy which is required for the operation of a detonator is provided by the battery 40 in the connector. This energy is transferred to the detonator via the conductor 18. The energy can be used directly to power electronic circuits in the detonator. Alternatively the energy storage device 66 is in the form of a capacitor and energy from the battery 40 is used to charge the capacitor, energy from the capacitor is used to provide a stable voltage source for operating electronic circuits in the detonator. When the detonator is to be fired, energy drawn from stored energy in the capacitor is used to fire the igniter 70.

The timing delay associated with the detonator is produced by the timer 62. However this timer could be eliminated and the timing delay would then be controlled by the timer 38 in the connector 20.

In the blasting system 10 control information and data are transmitted from the control unit 26 wirelessly to the various connectors 20. The signals employed for this purpose are uniquely encoded using the respective identifiers of the connectors, to ensure that target connectors are exclusively reached. In a reverse direction information and data are extracted by each connector 20 from the associated detonator 16 and are transmitted to the control unit 26.

The unique identification characteristics, associated with the respective detonator assemblies 76, allow each assembly to be addressed individually. Primary switching i.e. to render each detonator 16 operative, can be done via hardware as each assembly is deployed, or electronically via a suitable signal transmitted from the control unit 26 at some time before blasting is to take place. Control signals and data, which can be transmitted from the control unit 26, include switching signals, instructions to place a detonator, or elements thereof, in an activated or in a deactivated mode and programming information, firing signals, and the like.

To conserve power at each detonator assembly 76 techniques which are known in the art, such as placing each connector into a "sleep mode" and deactivating if no fire signal is received within a predetermined time period, can be adopted.

It also falls within the scope of the invention, as has been pointed out, for programming of each detonator assembly to be effected through the use of an appropriate tagger, typically a mobile device carried by an operator, or carried by an airborne mechanism such as a drone (UAV).

A significant benefit of the construction which has been outlined lies in the capability of each connector 20 to include one or more sensors 80 and a geographical positioning unit 82. The sensors 80 can be used to provide information on diverse aspects of a blasting installation prior to and immediately before firing of detonators takes place. The sensors 80, for example, may include temperature sensors, vibration sensors, noise and environmental monitoring modules, and the like. Information which is monitored and detected by the sensors is collected by the processor/logic unit 42, and is transmitted to the control unit 26 as required. Absolute or relative positional information is available via the geographical positioning unit 82.

The connector 20 is capable of transmitting information to the control unit 26 at all times up to the instant at which firing of the associated detonator 16 takes place. This extends to a capability to detect that a fire signal has been sent by the logic unit 64 to the igniter 70, and to notify the control unit 26 thereof.

If the conductor 18 includes electrical leads then communication with the detonator is via electrical signals which are impressed on and carried by the leads. The conductor 18 alternatively is a fibre-optic cable used to transmit signals at a light frequency to the detonator which then has a suitable light sensitive device, e.g. an LED at the terminals 74, and the connector 20 has a similar light-sensitive device at the terminals 56.

A firing signal could also be transferred to a detonator from a connector by means of a shock tube 80 which extends from an ignition point on the connector 20 to a coupling location 82, on the detonator, which is exposed to the igniter 70—this case the components 62, 66, 64, 64A and 68 in the detonator are not required and a timing function is provided by the timer 38 in the connector.

The invention claimed is:

1. A detonator assembly for use in a detonator system, the detonator assembly including a connector, a detonator, a memory storage unit in which is stored a first identifier which is unique to the connector and the detonator includes the first identifier or a second identifier which is uniquely linked to the first identifier, and at least one signal-transmitting conductor connected to the detonator and to the terminals of the connector, one or more sensors to monitor environmental and geographical parameters in a region of a borehole in which the detonator is located, the detonator including a firing element and a timer, a detonator identifier which is linked, uniquely, to the connector, the connector including a housing and, mounted in or on the housing, a power source, a radio receiver, a radio transmitter each adapted to receive signals from a control unit and to transmit signals to the control center, respectively, a processor/logic unit and terminals for connection to the at least on signal-transmitting conductor, at least one sensor to record data pertaining to the implementation and firing of the detonator system wherein the data is transmitted to a control unit by the radio transmitter and wherein the detonator system is operable in response to the control unit which includes a transmitter which can transmit a signal to the receiver in the connector.

2. A detonator assembly according to claim 1 wherein the signal-transmitting conductor includes at least one of the following: electrical leads, a fibre-optic cable, and a shock tube.

3. A detonator assembly according to claim 1 wherein the power source is a battery.

4. A detonator assembly according to claim 1 which includes a geographical positional device to provide real time absolute or relative positional information.

5. A detonator assembly according to claim 1 wherein the detonator is an electronic detonator and includes an energy-storage device.

6. A detonator assembly according to claim 1 wherein the environmental parameters are selected from temperature, vibration and noise.

7. A detonator system which includes a plurality of detonator assemblies, wherein each detonator assembly is according to claim 1, and wherein each detonator is positioned inside a respective borehole and is exposed to an explosive medium and each corresponding connector is positioned at surface adjacent a borehole which contains the detonator.

* * * * *